US005512910A

United States Patent [19]

Murakami et al.

[11] Patent Number: 5,512,910

[45] Date of Patent: Apr. 30, 1996

[54] MICROSTRIP ANTENNA DEVICE HAVING THREE RESONANCE FREQUENCIES

[75] Inventors: Yuichi Murakami, Kawasaki; Ieda Kiyokazu, Tokyo, both of Japan

[73] Assignee: Aisin Seiki, Co., Ltd., Japan

[21] Appl. No.: 234,634

[22] Filed: Apr. 28, 1994

Related U.S. Application Data

[63] Continuation of Ser. No. 964,466, Oct. 21, 1992, abandoned, which is a continuation of Ser. No. 248,722, Sep. 26, 1988, abandoned.

[30] Foreign Application Priority Data

Sep. 25, 1987 [JP] Japan ..... 62-241331

[51] Int. Cl.[6] ..... H01Q 1/38

[52] U.S. Cl. ..... 343/700 MS; 343/846

[58] Field of Search ..... 343/700 MS, 829, 343/846; H01R 1/38

[56] References Cited

U.S. PATENT DOCUMENTS

| | | | |
|---|---|---|---|
| 4,012,741 | 3/1977 | Johnson | 343/700 MS |
| 4,157,548 | 6/1979 | Kaloi | 343/700 MS |
| 4,259,670 | 3/1981 | Schiavane | 343/700 MS |
| 4,316,194 | 2/1982 | DeSantis et al. | 343/700 MS |
| 4,320,401 | 3/1982 | Schiavone | 343/700 MS |
| 4,356,492 | 10/1982 | Kaloi | 343/700 MS |
| 4,766,440 | 8/1988 | Gegan | 343/700 MS |
| 4,775,866 | 10/1988 | Shibata et al. | 343/700 MS |

OTHER PUBLICATIONS

National Radio Institute Text CC210–CC212, Wash, D.C., 1976, pp. CC211–10 to CC211–13.

*Primary Examiner*—Michael C. Wimer
*Attorney, Agent, or Firm*—Banner & Allegretti, Ltd.

[57] ABSTRACT

A microstrip antenna device is disclosed as having three resonance frequencies comprising, a dielectric sheet whose thickness is smaller than the used wave length, a radiating conductor sheet which is disposed on one surface of the dielectric sheet and which is a rectangular shape and has line load in the center of one side of the rectangle, and a ground conductor sheet disposed on the other surface of the dielectric sheet.

1 Claim, 4 Drawing Sheets

MICROSTRIP ANTENNA DEVICE HAVING THREE RESONANCE FREQUENCIES

This application is a continuation of application Ser. No. 07/964,466, filed Oct. 21, 1992, abandoned, which is a continuation of Ser. No. 07/248,722 filed Sep. 26, 1988, abandoned.

BACKGROUND OF THE INVENTION

1. Field of the Invention

This invention generally relates to a microstrip antenna device having three frequencies which can be used in three frequency bands.

2. Description of the Prior Art

Generally, microstrip antennas comprise a dielectric sheet with a conductor mounted on one surface and a ground conductor mounted on the other surface. Such an antenna utilizes the radiation loss of an open planar resonance circuit. Attention is now being focused on such microstrip antennas because of their low profile, reduced weight, compactness and ease of manufacture. However, the frequency band of such antennas is generally narrow thereby limiting such antennas usefulness to a single specific frequency band.

Until recently, attention has been focused on communications using a single frequency band. For example, in the case of communications between a vehicle moving within a town or city and a communication station, the ability to utilize more than two frequency bands is desired to accurately send information in a minimal amount of time. Further, it is preferred to be able to use at least three frequency bands for controlling and/or monitoring the communication.

When a plurality of frequency bands are used in the same area, a minimal deviation between bands of 5% is preferred to minimize interference. Accordingly, a microstrip antenna having more than one frequency band is desirable because of the constraints on the band width.

A microstrip antenna having two resonance frequencies is disclosed in Japanese Laid-Open Patent No. 56-141605 (1981). This antenna has a radiating conductive element and a feeder point located along one of the midlines of the angles of intersection between a long and short axis thereof. In this antenna, the excitation can occur in a long axis mode or a short axis mode so that the antenna is usable over two frequency bands. While this may represent an improvement over single frequency band microstrip antennas, it is not capable of being used with three frequency bands.

SUMMARY OF THE INVENTION

In order to overcome these and other deficiencies of the prior art, it is an object of the present invention to provide a microstrip antenna having three resonance frequencies for use in three frequency bands to allow greater flexibility.

Further objects of this invention will be apparent to one of ordinary skill in the art from the illustrative embodiments described below. The scope of the invention is only limited by the appended claims, and various advantages not referred to herein will occur to one skilled in the art upon employment of the invention in practice.

DETAILED DESCRIPTION OF THE PREFERRED EMBODIMENT

Figure 1A:
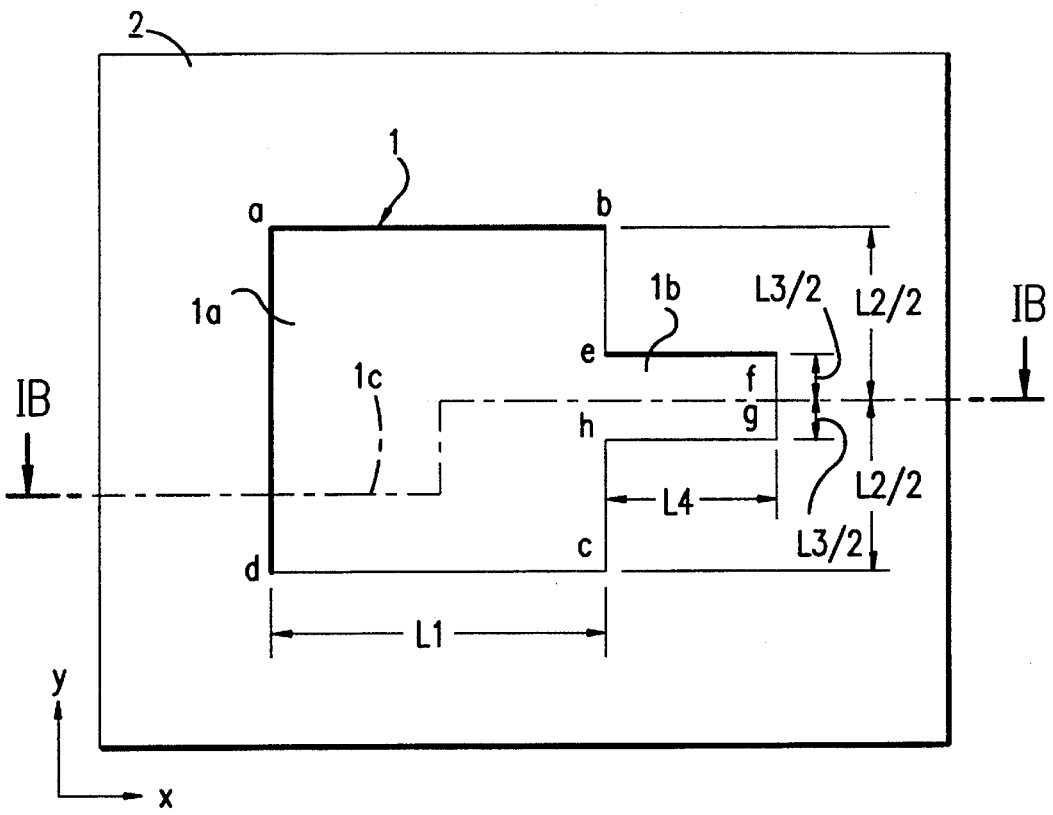
FIG. 1*a* is a plan view of a microstrip antenna having three resonance frequencies according to a preferred embodiment of the invention.
Figure 1B:
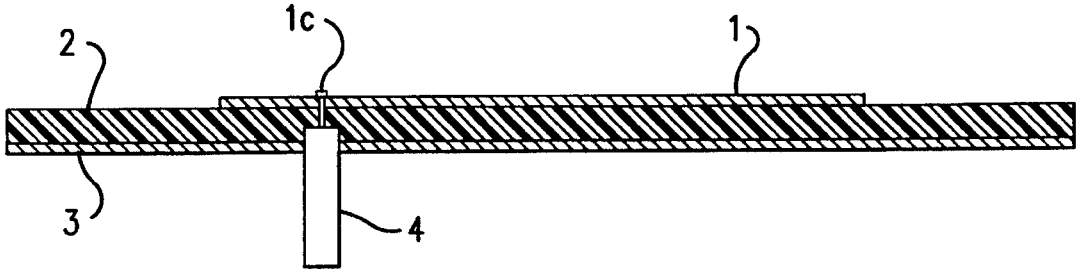
FIG. 1*b* is a cross-sectional view taken along line IB—IB in FIG. 1*a;*

An exemplary embodiment of the invention is shown in the drawings in which FIG. 1*a* is a plan view of a microstrip antenna device having three resonance frequencies and FIG. 1*b* is cross-sectional view taken along line IB—IB of the microstrip antenna in FIG. 1*a*.

This antenna comprises a dielectric sheet 2, a radiating conductor sheet 1 and a ground conductor sheet 3. Radiating conductor sheet 1 may be comprised of copper foil and located on one surface of dielectric sheet 2. The ground conductor sheet 3 may be comprised of copper foil and is located on an opposite surface of dielectric sheet 2. The radiating conductor sheet 1 may comprise a substantially rectangular portion 1*a* (defined by points a, b, c and d) and a substantially rectangular portion 1*b* (defined by points e, f, g, and h) which is smaller than the rectangle 1*a*. A midline of rectangular portion 1*b* passes through the midpoint of side ad of rectangular portion 1*a*. Rectangle 1*b* may represent a line load. A feeder point 1*c* may be located on diagonal line bd. An inner-conductor of a coaxial feeder line 4 passes through the dielectric sheet 2 from the reverse side and is soldered on radiating conductor sheet 1 at feeder point 1*c*. In this embodiment, the length L1 of the sides ab and cd and the length L2 of sides ad and bc are equal to $l_1$, the length L3 of the side fg is equal to $l_2$ and length L4 of sides ef and gh is equal to $l_1/2$.

The ground conductor sheet 3 covers all of the reverse side of dielectric sheet 2. The outer conductor of the coaxial feeder line 4 is soldered to ground conductor sheet 3 at feeder point 1*c*.

This antenna has two independent modes: TMmo mode and TMon mode. The TMmo mode corresponds to a component having a direction parallel to side ab, namely a component of vector x. The TMon mode corresponds to a component having a direction parallel to side ad, namely a component of vector y (m and n are natural numbers, and may be equal to 1 in the basic mode).

Figure 2:
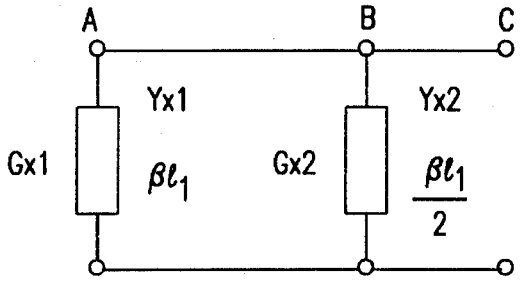
FIG. 2 shows an equivalent circuit diagram of FIG. 1*a* for a component of vector x.

FIG. 2 is an equivalent circuit diagram of FIG. 1*a* and 1*b* for a component of vector x. In this Figure, side AB corresponds to side ab of FIG. 1*a*, and side BC corresponds to side ef in FIG. 1*a*. Characteristic admittance Yx1 and radiating conductance Gx1 looking at point A from point B, and characteristic admittance Yx2 and radiating conductance Gx2 looking at point C from point B may be shown by the following expressions.

$$Yxi = \sqrt{\epsilon rei} \cdot li/(120\pi \cdot t) \quad (1)$$

Here, $$\epsilon rei = [(\epsilon r + 1)/2] + [(\epsilon r - 1)/(2 \cdot \sqrt{1 + 10t/li})]$$

r:electric permittivity of dielectric sheet 2;

t:thickness of dielectric sheet 2;

Fc: modulus of amendment for fringing effect;

$\lambda_o$: free space Wavelength of resonance frequency.

The resonance frequency is not related to the position of the feeder point. So, when we regard the feeder point as point B, the input admittance Yinx is from $\beta l_1 \cong \pi$, Yx1>>G, Yx2>>G, and $$Yinx = 2G + j[Yx1 \cdot \tan(\beta.l_1) + Yx2.\tan(\beta.l_1/2) \quad (3)$$

Here, β is a phase constant and shown as $2\pi/\lambda g$. The λg is a propagation wavelength on the radiating conductor sheet 1.

Figure 4:
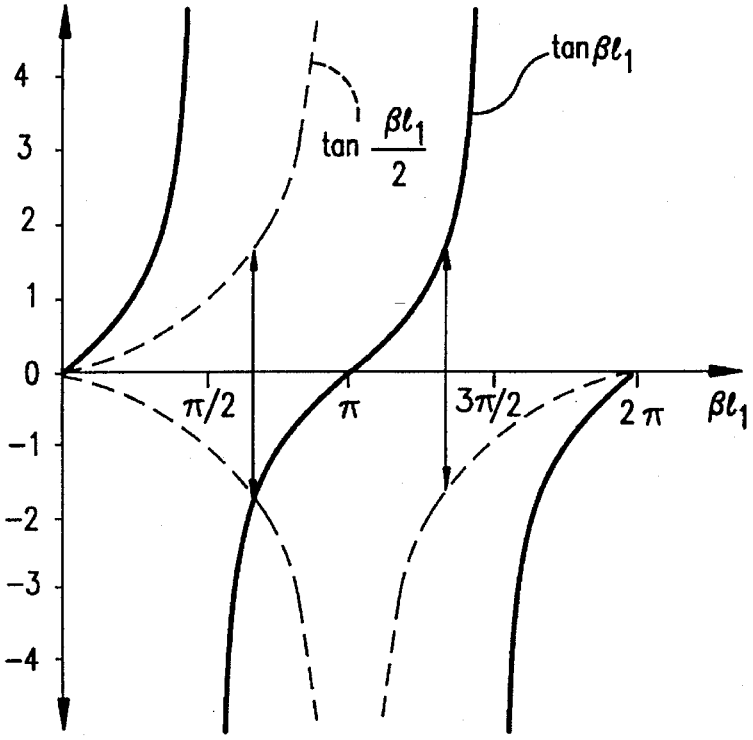
FIG. 4 is a graph showing tan ($\beta l_1$) and tan ($\beta l_1/2$)

FIG. 4 shows graphs of tan $(\beta.l_1)$ and tan $(\beta.l_1/2)$. Referring to FIG. 4, it is understood that the values of $\beta.l_1$ for which the imaginary term of expression (3) becomes equal to zero exists at two points, one on each side of $\beta.l_1=\pi$. The resonance frequency is a frequency which gives a value to $\beta.l_1$. There are two resonance frequencies in the component of vector x, lower frequency f1 and higher frequency f3.

Figure 3:
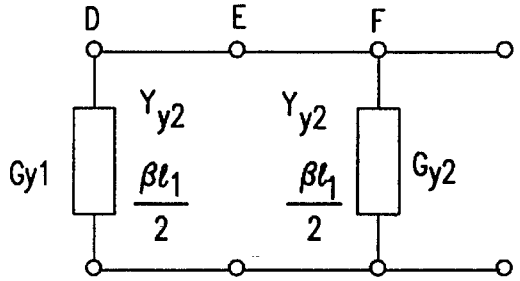
FIG. 3 shows an equivalent circuit diagram of FIG. 1*a* for a component of vector y.

FIG. 3 is an equivalent circuit diagram of FIG. 1*a* and 1*b* for a component of vector y. Characteristic admittance Yy1 and radiating conductance $G_{y1}$ looking at point D from midpoint E of the side DF and characteristic admittance Yy2 and radiating conductance Gy2 looking at point F from point E may be shown by the following expressions.

$$Yy1 = Yy2 = Yx1 \quad (4)$$

$$Gy1 = Gy2 = G \quad (5)$$

When point F corresponds to the feeder point, the input admittance Yiny of a component of vector y may be shown as follows:

$$Yiny = G + Y1[(G + jYy1 \tan(\beta.l_1)]/[Yy1 + jG \cdot \tan(\beta.l_1)] \quad (6)$$

When $\beta.l_1=\pi$, tan $(\beta.l_1)=0$ so that the imaginary term of expression (6) becomes zero. Frequency f2 is a resonance frequency of a component of vector y.

The input admittance Yiny of a component of vector y does not effect the expression shown in (6) in the case of no line load 1*b*, since the midpoint of side DF which is the input admittance Yiny' feeding from midpoint E of direction y is shown as follows.

$$Yiny' \cong j2Yy1 \cdot \tan(\beta.l_1/2) \quad (7)$$

Yiny' equals ±∞ at resonance frequency f2 so that the resonance frequency is not changed by connecting the bad to point E. Therefore, the line load 1B does not effect the resonance frequency f2 of a component of vector y.

Figure 5:
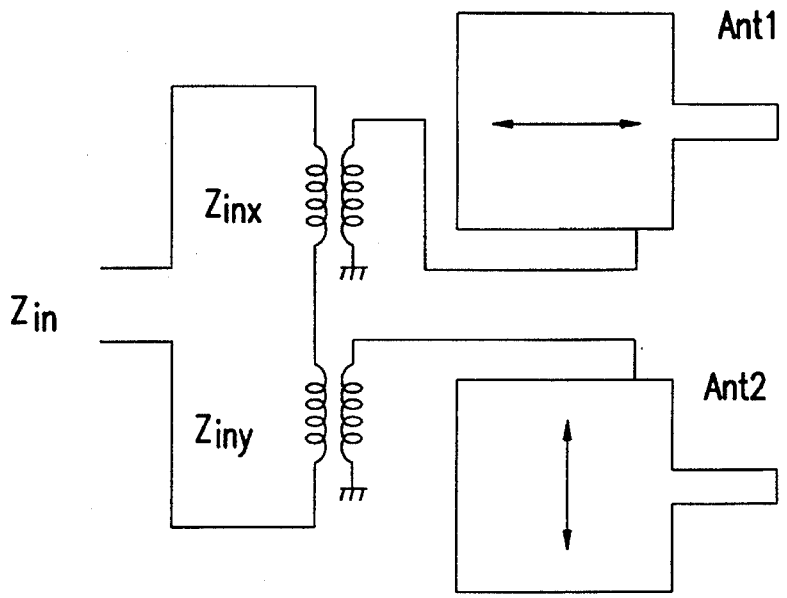
FIG. 5 shows an equivalent circuit representation of the antenna in FIG. 1*a;*

Accordingly, the antenna of this embodiment is equal to an antenna Ant1 having an input impedance Zinx having two resonance frequencies f1 and f3 and an antenna Ant2 having an input impedance Ziny having one resonance frequency f2 as shown in FIG. 5. Here, the resonance frequencies are f1, f2, and f3. The arrows in FIG. 5 show the modes of excitation.

Figure 6:
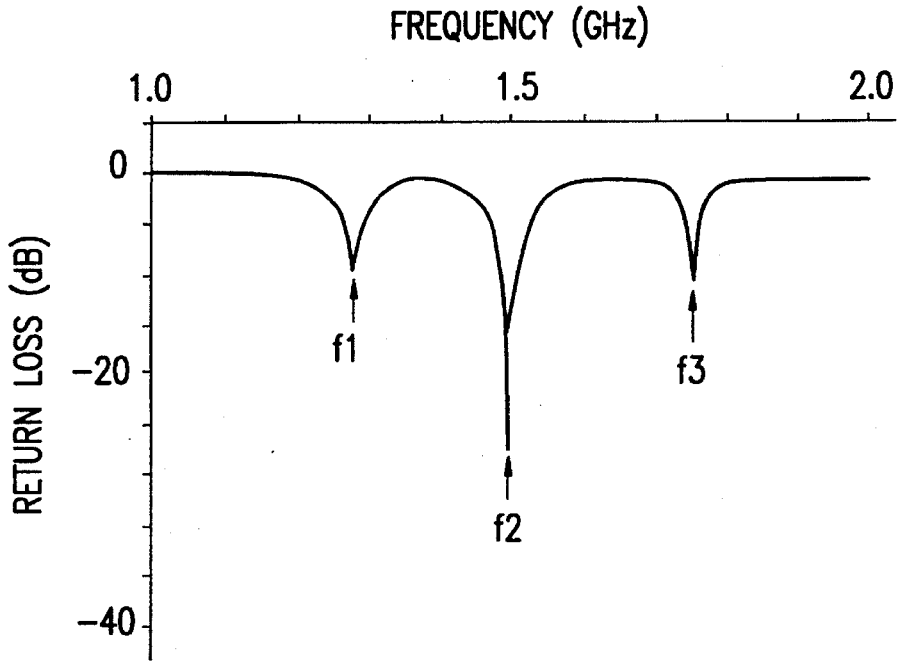
FIG. 6 is a graph plotting excited vibration frequency vs. return loss.

The graph shown in FIG. 6 shows the return loss when the antenna of this embodiment is excited at frequencies from 1.0 GHz to 2.0 GHz. The return loss indicates the reflection loss of the electric feeder power with OdB corresponding to all reflection. Referring to this graph, the absolute value of the return loss is large at three frequencies (f1, f2 and f3); at which frequencies the antenna is excited. It can therefore be seen from the above that the antenna has three resonance frequencies.

Figure 7:
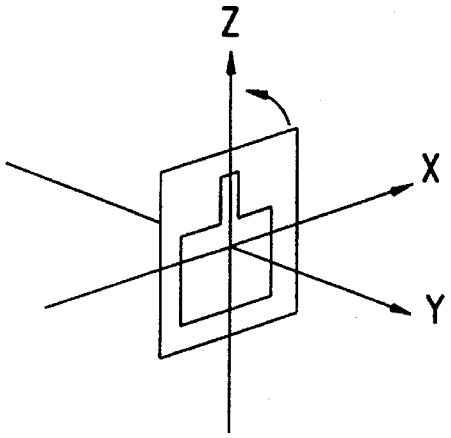
FIG. 7 is a perspective view of a coordinate system established for the antenna of FIG. 1*a* for measurement purposes.
Figure 8A:
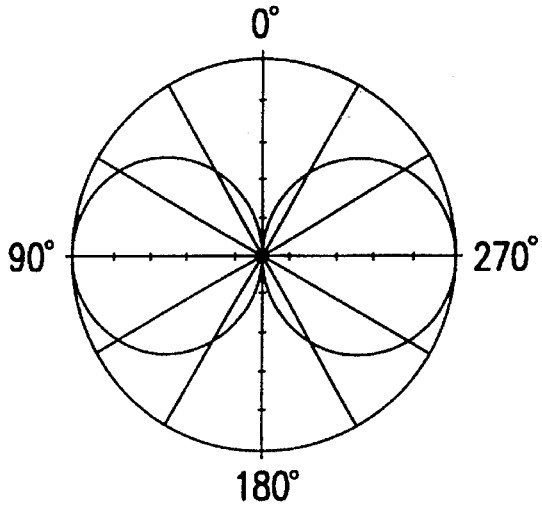
FIG. 8*a*, 8*b* and 8*c* are graphs showing planes of polarization of excited vibration at resonance frequencies f1, f2 and f3, respectively.
Figure 8B:
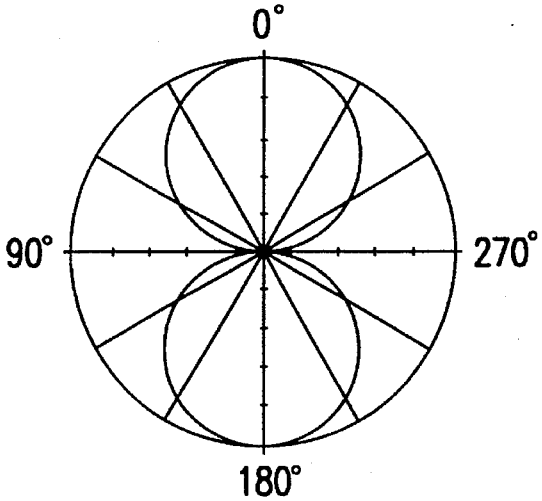
Figure 8C:
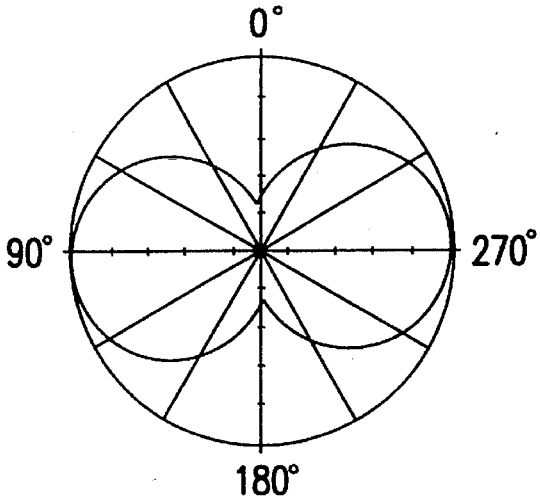

FIGS. 8*a*, 8*b* and 8*c* show the planes of polarization of the antenna when excited at resonance frequencies fl, f2 and f3, respectively. This measurement is taken by disposing the antenna of this embodiment to the X-Y plane as shown in FIG. 7, disposing a dipole antenna for measurement on the Y axis and rotating the antenna of this embodiment counter clockwise. Referring to FIG. 8*a*, the antenna becomes a horizontally polarized wave when excited by resonance frequency f1. Referring to FIG. 8*b*, the antenna becomes a vertically polarized wave when excited by resonance frequency f2. Referring to FIG. 8*c*, the antenna becomes horizontally polarized when exated by resonance frequency f3. The plane of polarization is changed by the resonance frequency. If this antenna is used to discriminate the plane of polarization for example, the changing of the attitude of the antenna is not necessary.

In the above embodiment, the line load is an open line, but the characteristic is the same for a closed line. In that case, the length of the line load (L4 in FIG. 1*a*) may be l.

While there has been shown and described particular embodiments of the invention, it will be apparent to those skilled in the art that various changes and modifications may be made without departing from the scope and spirit of the invention in its broader aspects and the invention is only limited by the appended claims claims which are intended to cover all such changes and modifications that fall within the true spirit and scope of the invention.

We claim:

1. A microstrip antenna device having three resonant frequencies comprising:

a dielectric sheet having a thickness smaller than a wavelength of one of the resonant frequencies;

a first radiating conductor sheet disposed on one surface of said dielectric sheet and which is substantially rectangularly shaped;

a second conductor sheet located substantially in the center of and connected to one side of said rectangularly shaped first radiating conductor sheet and forming two minimum input admittances at respective first and second resonant frequencies of the three resonant frequencies; and a ground conductor sheet disposed on a second surface of said dielectric sheet;

wherein said device has a feed point located substantially on a line diagonally bisecting said substantially rectangularly shaped first radiating conductor sheet to generate two perpendicular planes of polarization, and wherein said feed point is separated from the second conductor sheet, and wherein:

the first radiating conductor sheet forms a first sheet characteristic admittance Yx1; and the feed point is characterized by an input admittance defined by $$2G + j\{Yx1 * \tan(2\pi L1/\lambda_g) + Yx2 * \tan(2\pi L4/\lambda_g)\},$$

Yx2 being the second sheet characteristic admittance, G being the radiating conductance, L1 being a length of the first radiating conductor sheet, L4 being a length of the second conductor sheet, the first and second resonant frequencies corresponding to values of $\lambda_g$ where the imaginary part of the input admittance equals zero.

* * * * *

UNITED STATES PATENT AND TRADEMARK OFFICE

CERTIFICATE OF CORRECTION

PATENT NO. : 5,512,910

DATED : April 30, 1996

INVENTOR(S) : Yuichi Murakami et al.

It is certified that error appears in the above-indentified patent and that said Letters Patent is hereby corrected as shown below:

On the title page, item:

"[75] Inventors: Yuichi Murakami, Kawasaki; Ieda Kiyokazu, Tokyo, both of Japan"

change to --[75] Inventors: Yuichi Murakami, Kawasaki; Kiyokazu Ieda, Tokyo, both of Japan--.

Signed and Sealed this

Twenty-first Day of April, 1998

Bruce Lehman

*Attest:*

BRUCE LEHMAN

*Attesting Officer*

*Commissioner of Patents and Trademarks*